United States Patent [19]

Shaw

[11] Patent Number: 4,805,670

[45] Date of Patent: Feb. 21, 1989

[54] METHOD AND APPARATUS FOR DETECTING CLINGING WARP THREADS IN A WEAVING MACHINE

[75] Inventor: Henry Shaw, Vleteren, Belgium

[73] Assignee: Picanol N.V., Belgium

[21] Appl. No.: 98,302

[22] Filed: Sep. 18, 1987

[30] Foreign Application Priority Data

Sep. 24, 1986 [NL] Netherlands ..... 8602410

[51] Int. Cl.[4] ..... D03D 51/28

[52] U.S. Cl. ..... 139/353; 139/336

[58] Field of Search ..... 139/336 R, 353, 354, 139/352; 28/187; 66/157

[56] References Cited

U.S. PATENT DOCUMENTS

| | | | |
|---|---|---|---|
| 2,512,165 | 6/1950 | Meier . | |
| 2,834,381 | 5/1958 | Grangier . | |
| 3,725,911 | 4/1973 | Cook et al . | |
| 3,989,068 | 11/1976 | Kakinaka | 139/353 |

FOREIGN PATENT DOCUMENTS

| | | |
|---|---|---|
| 801920 | 12/1950 | Fed. Rep. of Germany . |
| 1535597 | 12/1970 | Fed. Rep. of Germany . |
| 708306 | 7/1931 | France . |
| 982218 | 6/1951 | France . |
| 6081355 | 10/1983 | Japan . |

*Primary Examiner*—Henry S. Jaudon

*Attorney, Agent, or Firm*—Bacon & Thomas

[57] ABSTRACT

Method for detecting the presence or absence of warp threads clinging together, with the characteristic that it consists principally of a combination of: initiating a machine stop when a warp stop signal is received indicating that a contact has been made by a drop wire 9; checking for a fallen drop wire 9A; and, if no fallen drop wire is found, restarting the machine at least once and interpreting a warp stop motion generated upon restart as an indication that the warp threads 2 are clinging together.

10 Claims, 1 Drawing Sheet

METHOD AND APPARATUS FOR DETECTING CLINGING WARP THREADS IN A WEAVING MACHINE

FIELD OF THE INVENTION

This invention concerns a method and apparatus for detecting whether or not warp threads are clinging together as they are unwound from the warp beam in a weaving machine.

DESCRIPTION OF PRIOR ART

A well-known technique used on weaving machines in order to detect warp breaks consists of a warp stop motion in which each warp thread supports a drop wire, so that if a thread breaks the corresponding drop wire falls and makes an electrical contact, ie. closes a pair of electrodes. As a result of this electrical contact being made, a warp stop signal is sent, and this signal is used to initiate a machine stop.

However, as is known, such a signal from the warp stop motion may not necessarily be the result of a warp break, in which case a "false stop" occurs. Such false stops can have various causes.

One possible cause of a false stop may be slack in one of the warp threads, so that the corresponding drop wire closes the contact with the electrode.

Another cause of a false stop may be one or more of the drop wires jiggling up and down as a result of vibrations set up during the weaving process, so that at the lowest point of the jiggle they close the contact with the electrode.

It is common technology not to take account of warp stop signals of short duration, in order to prevent jiggling drop wires causing a machine stop.

A third possible cause of false machine stops may be two or more adjacent warp threads clinging together along part of their length, thus forming a "strap" of the warp.

Such a strap is usually due to an accumulation of the dust that occurs in any weaving mill.

Dust from the weaving shed always falls on the warp. Since during the weaving process the warp threads pass through the drop wires, large accumulations of dust naturally occur at the warp stop motion, in particular at the row of drop wires nearest the warp beam. Such an accumulation can lead to two or more warp threads clinging together, thus forming a strap. This strap may then drag one of the drag wires forward with it as a result of the motion of the warp threads. Due to its relatively light construction the drop wire is liable to be completely twisted out of shape so that contact is made between the two corresponding electrodes. The resulting stop motion signal results in a machine stop, as explained above. Such clinging together of the warp threads may not necessarily be due to an accumulation of dust; it may also be caused by faulty winding on the warp beam.

BRIEF DESCRIPTION OF THE INVENTION

The aim of the present invention is to provide a method and a weaving machine in which this disadvantage does not occur. The invention first of all concerns a method for detecting whether or not warp threads are clinging together, with the characteristic that the method consists of a combination of: initiating a machine stop on reception of a warp stop signal indicating that a contact has been made by a drop wire; checking for a fallen drop wire; starting the machine again at least once if no fallen drop wire is found; and interpreting the warp stop signal that results when the machine starts again, in order to determine whether the warp threads are clinging together.

Checking for a fallen drop wire, for example, can be done by means of a drop wire locator, e.g. as described in U.S. patent application No. 014,778, filed Feb. 3, 1987, owned by the assignee of this patent application, now U.S. Pat. No. 4,791,967.

DESCRIPTION OF THE DRAWING

In order to explain the characteristics of the invention, by way of example only and without being limitative in any way, the following variants of said method and apparatus are described below with reference to the accompanying drawings, where.

DETAILED DESCRIPTION OF THE PREFERRED EMBODIMENTS

Figure 1:
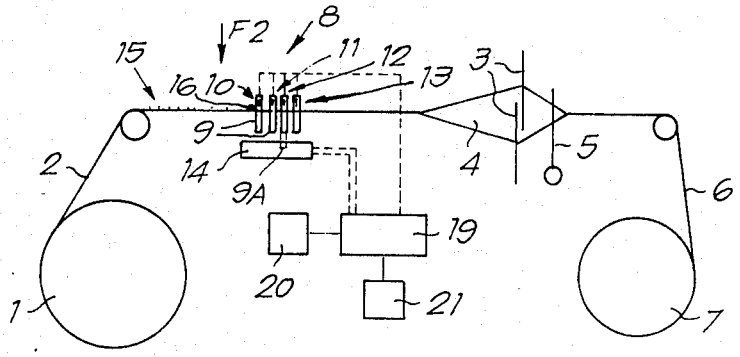
FIG. 1 is a schematic diagram of a weaving machine according to the invention, showing an accumulation of dust.

FIG. 1 is a schematic representation of the usual parts involved in the weaving process, namely the warp beam 1, the warp threads 2, the heddles 3 for forming the shed 4, the reed 5 for beating in the weft threads, the woven cloth 6 and the cloth beam 7.

As in the usual method for timely detection of breaks in the warp threads 2, the warp stop motion 8 has drop wires 9 suspended on the warp threads. The drop wires are normally arranged in several rows, respectively 10 to 13 in this diagram. When a warp thread breaks, the corresponding drop wire 9 falls and makes an electrical contact, thus resulting in a machine stop.

Additionally, a drop wire locator 14 may be mounted underneath the warp stop motion in order to detect and locate the fallen drop wire 9A, as described in U.S. Pat. No. 4,791,967 identified above.

Figure 2:
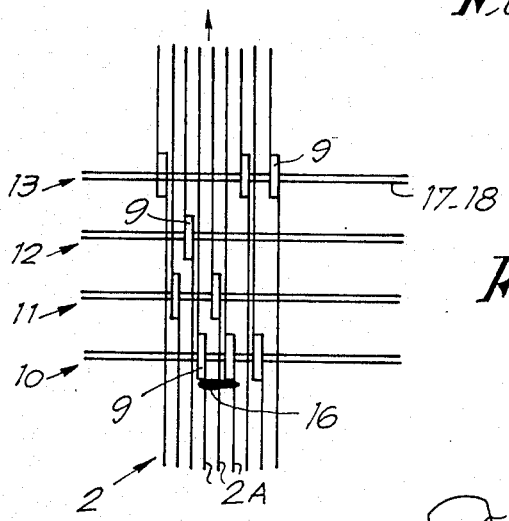
FIG. 2 is a view in the direction of arrow F2 in FIG. 1.

Dust 15 generated during the weaving process usually falls on the warp threads 2. As can be expected, this dust 15 forms an accumulation 16 at the warp stop motion 8, in particular at the row of drop wires 10 nearest the warp beam 1. As shown in FIG. 2, such as accumulation 16 can lead to several warp threads 2A clinging together and thus forming a strap.

Figure 3:
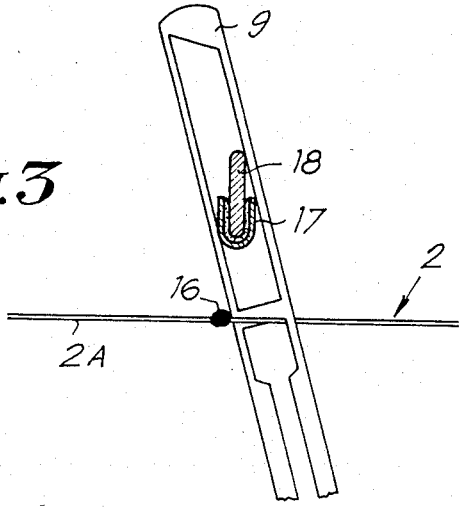
FIG. 3 shows how, as a result of warp threads clinging together, a drop wire can make contact between two electrodes of the warp stop motion.

FIG. 3 shows how this dust accumulation 16 can result in a drop wire 9 being dragged along by the warp threads 2, until it is bent out of shape so much that an electrical contact is made between the warp stop electrodes 17 and 18, thus generating a warp stop signal and initiating a machine stop.

In order to determine whether such a machine stop is in fact due to warp threads 2A clinging together, the method of the invention is used, as described below.

In a first variant, when a machine stop occurs a check is made for a fallen drop wire 9A, e.g. by means of the abovementioned drop wire locator. If no fallen drop wire 9A is detected or observed, the weaving machine is restarted. If immediately after the restart a warp stop signal resulting in a machine stop once more occurs, then there is a very high degree of probability that a number of warp threads 2A are clinging together; what is certain is that there are no fallen drop wires 9A, otherwise they would have been detected by the drop wire locator.

Furthermore, stopping and restarting the machine rules out the possibility of the stop having been caused by jiggling of the drop wires 9. The only remaining possibility is the presence of a "strap". In the method of the invention, the second warp stop signal is therefore used to indicate that a number of warp threads are clinging together.

In a second variant of the method of the invention, when a machine stop occurs a check is first made for a fallen drop wire 9A. If no fallen drop wire 9A is detected or observed the machine is restarted. If immediately after the restart a machine stop once more occurs, a second check for a fallen drop wire is carried out by means of the drop wire detector 14.

If no fallen drop wire is detected or observed as a result of this second check, then according to the invention this datum is used to indicate that a number of warp threads 2A are very probably clinging together.

In a variation of the method just described, after the second check for a fallen drop wire 9A the machine can be restarted for a second time. If a machine stop occurs again immediately after this restart, then according to the invention this datum is used to signal that a number of warp threads are clinging together.

In a third variant of the method of the invention, when a machine stop occurs a check is first made for a fallen drop wire 9A. If no drop wire 9A is found the machine is restarted. If immediately after the restart a machine stop once more occurs, a check is made to discover whether the drop wire 9A that instigated the stop motion signal is located on the same row 10–13 as on the previous stop. If there is a strap, it will obviously result in the same drop wire contact being made.

If this second check reveals that the drop wire 9A that instigated the stop motion signal is in fact located on the same row 10–13, then according to the invention this datum is used to indicate that a number of warp stop threads 2A are very probably clinging together.

In yet another variant, use is made of the fact that when a number of warp threads 2 cling together it is very probable that the resulting warp stop signal was instigated by the drop wire row 10 nearest the warp beam 1. In this variant, when a machine stop occurs a check is first made for a fallen drop wire 9A. If no fallen drop wire 9A is found the machine is restarted. If however a second machine stop occurs immediately after the restart, then in this variant of the invention a check is made to discover in which drop wire row 10–13 a contact has been made.

If the contact has been made in the drop wire row 10 nearest the warp beam 1, a signal is given to indicate that a number of warp threads are very probably clinging together. Clearly, this allows the weaver to intervene manually whenever such a signal indicating several drop wires 2A clinging together is given.

However, the method of the invention may be made fully automatic.

A weaving machine using the method of the invention will have e.g. a control unit 19 connected to: the warp stop motion 8, the drop wire locator 14, a signalling unit 20 and the main drive 20 of the weaving machine. The control unit 19 can consist essentially of a number of logic circuits and start-stop circuits for switching the drop wire detector 14 and drive 21 in and out. Such components are already well known, and so do not need further description here. The configuration of the control unit 19 can be quite clearly understood on the basis of the method of the invention as so far described. The present invention is by no means limited to the methods herein described by way of example; on the contrary, such methods for detecting the presence or absence of warp threads clinging together can be implemented in different variants while still remaining within the scope of the invention.

I claim:

1. A method for operating a weaving machine, in particular, for detecting a stop motion signal caused by clinging warp threads, said weaving machine including a warp defect stop motion means arranged to generate a stop motion signal upon detection of a warp thread defect by means of warp thread engaging drop wires that fall to make an electrical contact when a warp thread break occurs, and make an electrical contact without falling when displaced by clinging warp threads or warp thread straps, said drop wires being detectable when in their fallen condition, comprising the steps of:

(a) stopping the weaving motion in response to a stop motion signal generated by the stop motion means;
(b) detecting whether or not a drop wire has fallen;
(c) if no drop wire is detected, restarting the weaving machine;
(d) upon the generation of a second stop machine signal immediately upon restarting the weaving machine, stopping the weaving machine a second time; and
(e) upon stopping of the weaving machine the second time, providing a signal indicative of the presence of clinging warp threads.

2. A method for operating a weaving machine, in particular, for detecting a stop motion signal caused by clinging warp threads, said weaving machine including a warp defect stop motion means arranged to generate a stop motion signal upon detection of a warp thread defect by means of warp thread engaging drop wires that fall to make an electrical contact when a warp thread break occurs, and make an electrical contact without falling when displaced by clinging warp threads or warp thread straps, said drop wires being detectable when in their fallen condition, comprising the steps of:

(a) stopping the weaving motion in response to a stop motion signal generated by the stop motion means;
(b) detecting whether or not a drop wire has fallen;
(c) if not drop wire is detected, restarting the weaving machine;
(d) upon the generation of a second stop motion signal immediately upon restarting the weaving machine, stopping the weaving machine a second time; and
(e) detecting a second time whether or not a drop wire has fallen; and
(f) if no fallen drop wire is detected, providing a signal indicative of the presence of clinging warp threads.

3. A method for operating a weaving machine, in particular, for detecting a stop motion signal caused by clinging warp threads, said weaving machine including a warp defect stop motion means arranged to generate a stop motion signal upon detection of a warp thread defect by means of warp thread engaging drop wires that fall to make an electrical contact when a warp thread break occurs, and make an electrical contact without falling when displaced by clinging warp threads or warp thread straps, said drop wires being detectable when in their fallen condition, comprising the steps of:

(a) stopping the weaving motion in response to a stop motion signal generated by the stop motion means;
(b) detecting whether or not a drop wire has fallen;
(c) if no drop wire is detected, restarting the weaving machine;
(d) upon the generation of a second stop motion signal immediately upon restarting the weaving machine, stopping the weaving machine a second time;
(e) detecting a second time whether or not a drop wire has fallen;
(f) if not fallen drop wire is detected, restarting the weaving machine a second time;
(g) upon generation of a third stop motion signal immediately upon restarting the weaving machine; stopping the machine a third time; and
(h) upon stopping of the weaving machine the third time, providing a signal indicative the presence of clinging warp threads.

4. A method for operating a weaving machine, in particular, for detecting a stop motion signal caused by clinging warp threads, said weaving machine including a warp defect stop motion means arranged to generate a stop motion signal upon detection of a warp thread defect by means of warp thread engaging drop wires that fall to make an electrical contact when a warp thread break occurs, and make an electrical contact without falling when displaced by clinging warp threads or warp thread straps, said drop wires being detectable when in their fallen condition, comprising the steps of:

(a) stopping the weaving motion in response to a stop motion signal generated by the stop motion means;
(b) detecting whether or not a drop wire has fallen and determining the row in which the drop wire is located that instigated the stop motion signal;
(c) if no fallen drop wire is detected, restarting the weaving machine;
(d) upon generation of a second stop motion signal immediately upon restarting the weaving machine, stopping the weaving machine a second time; and
(e) determining whether the second stop motion signal was instigated by a drop wire located in the same row as the drop wire that instigated the previous stop signal;
(f) generating a signal indicative of the presence of clinging warp threads if the drop wires instigating the two previous stop motion signals are located in the same row.

5. A method for operating a weaving machine, in particular, for detecting a stop motion signal caused by clinging warp threads, said weaving machine including a warp beam, a warp defect stop motion means arranged to generate a stop motion signal upon detection of a warp thread defect by means of warp thread engaging drop wires that fall to make an electrical contact when a warp thread break occurs, and make an electrical contact without falling when displaced by clinging warp threads or warp thread straps, said drop wires being detectable when in their fallen condition, said drop wires arranged in rows extending parallel to the warp beam, comprising the steps of:

(a) stopping the weaving motion in response to a stop motion signal generated by the stop motion means;
(b) detecting whether or not a drop wire has fallen;
(c) if no drop wire is detected, restarting the weaving machine;
(d) upon generation of a stop motion signal immediately upon restarting the weaving machine, determining if the fallen drop wire that instigated the second stop motion signal is located in the drop wire row closest the warp beam; and
(e) if the fallen drop wire that instigated the second stop motion signal is in the row closest the warp beam, providing a signal indicative of the presence of clinging warp threads.

6. In a weaving machine including a warp stop motion signal generating means, means for stopping the weaving machine upon generation of a warp stop motion signal, and means responsive to the occurrence of at least two immediately successive stop motion signals separated by stopping of the weaving machine with no fallen drop wire present and restarting of the weaving machine for generating a signal indicative of the presence of clinging warps threads.

7. In a weaving machine including a warp stop motion signal generating means, means for stopping the weaving machine upon generation of a warp stop motion signal, and means responsive to the occurrence of at least two immediately successive stop motion signals in the absence of a fallen drop wire for generating a signal indicative of the presence of clinging warp threads.

8. In a weaving machine including a warp stop motion signal generating means, means for stopping the weaving machine upon generation of a warp stop motion signal, and means responsive to at least three immediately successive stop motion signals separated by the stopping of the weaving machine upon the generation of each stop motion signal in the absence of a fallen drop wire following each generation of a stop motion signal for generating a signal indicative of the presence of clinging warp threads.

9. A weaving machine including a warp stop motion signal generating means including drop wires arranged in rows and means for indicating the row in which a drop wire responsible for instigating a stop motion signal is located, means for stopping the weaving machine upon generation of a warp stop motion signal, and means responsive to the occurrence of at least two immediately successive stop motion signals in the absence of a fallen drop wire with said at least two succcessive stop motion signals instigated by drop wires in the same row for generating a signal indicative of the presence of clinging warp threads.

10. In a weaving machine including a warp stop motion signal generating means, a warp beam, said warp stop motion signal generating means comprising drop wires located in rows extending parallel to the warp beam, means for stopping the weaving machine upon generation of a warp stop motion signal, and means responsive to the occurrence of at least two immediately successive stop motion signals in the absence of a fallen drop wire with a drop wire in the row nearest the warp beam instigated the stop motion signals for generating a signal indicative of the presence of clinging warp threads.

* * * * *